US007565095B2

(12) United States Patent
Mori

(10) Patent No.: US 7,565,095 B2
(45) Date of Patent: Jul. 21, 2009

(54) BELT DEVICE AND IMAGE FORMING APPARATUS

(75) Inventor: Hirotaka Mori, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 410 days.

(21) Appl. No.: 11/474,984

(22) Filed: Jun. 27, 2006

(65) Prior Publication Data

US 2007/0029717 A1 Feb. 8, 2007

(30) Foreign Application Priority Data

Jun. 30, 2005 (JP) ..... 2005-191576

(51) Int. Cl.
*G03G 15/00* (2006.01)

(52) U.S. Cl. ..... 399/165; 198/806; 198/814

(58) Field of Classification Search ..... 198/806, 198/813, 814; 399/165
See application file for complete search history.

(56) References Cited

U.S. PATENT DOCUMENTS

| | | | | |
|---|---|---|---|---|
| 4,462,676 | A * | 7/1984 | Shimura et al. | 399/165 |
| 5,659,850 | A * | 8/1997 | Reeder et al. | 399/165 |
| 6,160,978 | A * | 12/2000 | Tsuruoka et al. | 399/165 |
| 6,192,210 | B1 * | 2/2001 | Munenori et al. | 399/165 |
| 6,928,256 | B2 * | 8/2005 | Matsuda et al. | 399/308 |
| 7,136,611 | B1 * | 11/2006 | Murase | 399/165 |
| 2002/0034400 | A1 * | 3/2002 | Asuwa et al. | 399/165 |
| 2003/0206749 | A1 | 11/2003 | Kawshiwabara et al. | |
| 2005/0031377 | A1 | 2/2005 | Kabata et al. | |
| 2006/0172097 | A1 | 8/2006 | Morikoshi et al. | |

FOREIGN PATENT DOCUMENTS

| | | | | |
|---|---|---|---|---|
| EP | 1555229 | A2 | 7/2005 | |
| JP | 06130871 | A * | 5/1994 | 399/165 |
| JP | 2000-238926 | | 9/2000 | |
| JP | 2000-255820 | | 9/2000 | |
| JP | 2001-042662 | | 2/2001 | |

(Continued)

OTHER PUBLICATIONS

Japanese Office Action, Patent Application No. 2005-191576 Mailing Date Nov. 11, 2008.

(Continued)

*Primary Examiner*—Mark A Deuble
(74) *Attorney, Agent, or Firm*—Banner & Witcoff, Ltd

(57) ABSTRACT

A belt is looped around a plurality of rollers including a drive roller and a follow roller. The belt has an inner peripheral surface facing inside of a loop of the belt and an outer peripheral surface opposite the inner peripheral surface. The belt has a first widthwise edge and a second widthwise edge. A widthwise-movement restricting member is disposed on the inner peripheral surface on a first widthwise edge side. The widthwise-movement restricting member restricts widthwise movement of the belt in a direction toward a second widthwise edge side. An expansion-contraction restricting member is disposed on the second widthwise edge side on at least one of the inner peripheral surface and the outer peripheral surface. The expansion-contraction restricting member is less expandable in a peripheral direction of the belt than the widthwise-movement restricting member is. An urging member applies tension to the belt in the peripheral direction.

20 Claims, 4 Drawing Sheets

FOREIGN PATENT DOCUMENTS

| | | |
|---|---|---|
| JP | 2002-023509 | 1/2002 |
| JP | 2002-268455 | 9/2002 |
| JP | 2003-255642 | 9/2003 |
| JP | 2004-177600 | 6/2004 |
| JP | 2004-264522 | 9/2004 |
| JP | 2005-084247 | 3/2005 |

OTHER PUBLICATIONS

European Search Report, dated Mar. 19, 2007, in EP 06012552, previously submitted on Apr. 19, 2007.

* cited by examiner

BELT DEVICE AND IMAGE FORMING APPARATUS

CROSS REFERENCE TO RELATED APPLICATIONS

This application claims priority from Japanese Patent Application No. 2005-191576 filed Jun. 30, 2005. The entire content of the priority application is incorporated herein by reference.

TECHNICAL FIELD

The disclosure relates to a belt device and an image forming apparatus, and particularly to a belt device such as a photosensitive belt device, intermediate transfer belt device, and paper-conveying belt device employed in an image forming apparatus.

BACKGROUND

Conventional image forming apparatuses and the like employ a belt device for conveying paper or a developer image and for performing intermediate transfer of a developer image. This type of belt device employs a plurality of rollers and an endless belt looped around the rollers. The endless belt may become skewed and shift in position in the widthwise direction of the belt due to forces acting in the widthwise direction. Techniques for preventing skewing and widthwise positional shift in the belt have been proposed. For example, a technique disclosed in Japanese Patent Application Publication No. 2003-255642 provides a guide rib on one side of the belt and a groove formed in a roller for engaging with the guide rib to prevent skew toward the other side of the belt. This technology also urges both ends of a rotational shaft in a roller with springs in order to apply tension to the belt along the circumference thereof. The urging force of the spring on the side of the roller near the groove is set greater than the urging force of the spring on the opposite side of the roller in order to produce a greater tension along the circumference of the belt on the side having the guide rib than the opposite side of the belt. This tension differential in the belt produces a force component acting in a direction from the side having the guide rib toward the side not having the guide rib. Consequently, the guide rib and groove structure restricts movement of the belt from the guide rib side toward the side not having the guide rib and also prevents skewing and widthwise positional shift of the belt by pulling the belt from the side having the guide rib toward the side not having the guide rib.

SUMMARY

However, the springs employed in the above-described structure are often irregular in their urging forces, even among the same types of springs. Consequently, it is necessary to provide springs having a sufficiently large difference in urging force to ensure that the spring farthest from the groove in the roller is not accidentally greater than the force of the spring nearest the groove due to such irregularity. As a result, the urging forces applied to the belt are uneven along the widthwise direction thereof. The peripheral surface on the side of the roller urged by the stronger spring contacts the belt with a greater force that can shorten the life of the belt. In worst cases, the belt may incur damage or the edges of the belt may fold back on the belt.

In view of the foregoing, it is an object of one aspect of the invention to provide a belt device that prevents skewing and widthwise positional shift without applying a large load to the belt and an image forming apparatus equipped with such belt device.

In order to attain the above and other objects, one aspect of the invention provides a belt device. The belt device includes a plurality of rollers, a belt, a widthwise-movement restricting member, an expansion-contraction restricting member, and an urging member. The plurality of rollers includes a drive roller configured to be supplied with a driving force, and a follow roller that follows rotation of the drive roller The belt is looped around the plurality of rollers. The belt has an inner peripheral surface facing inside of a loop of the belt and an outer peripheral surface opposite the inner peripheral surface. The belt has a first widthwise edge and a second widthwise edge opposite the first widthwise edge in a widthwise direction. The widthwise-movement restricting member is disposed on the inner peripheral surface on a first widthwise edge side. The widthwise-movement restricting member restricts widthwise movement of the belt in a direction toward a second widthwise edge side. The expansion-contraction restricting member is disposed on the second widthwise edge side on at least one of the inner peripheral surface and the outer peripheral surface. The expansion-contraction restricting member is less expandable in a peripheral direction of the belt than the widthwise-movement restricting member is. The urging member applies tension to the belt in the peripheral direction.

Another aspect of the invention provides an image forming apparatus. The image forming apparatus includes a conveying unit and an image forming unit. The conveying unit conveys a recording medium. The image forming unit forms an image on the recording medium conveyed by the conveying unit. At least one of the conveying unit and the image forming unit includes a belt device. The belt device includes a plurality of rollers, a belt, a widthwise-movement restricting member, an expansion-contraction restricting member, and an urging member The plurality of rollers includes a drive roller configured to be supplied with a driving force, and a follow roller that follows rotation of the drive roller. The belt is looped around the plurality of rollers. The belt has an inner peripheral surface facing inside of a loop of the belt and an outer peripheral surface opposite the inner peripheral surface. The belt has a first widthwise edge and a second widthwise edge opposite the first widthwise edge in a widthwise direction. The widthwise-movement restricting member is disposed on the inner peripheral surface on a first widthwise edge side. The widthwise-movement restricting member restricts widthwise movement of the belt in a direction toward a second widthwise edge side. The expansion-contraction restricting member is disposed on the second widthwise edge side on at least one of the inner peripheral surface and the outer peripheral surface. The expansion-contraction restricting member is less expandable in a peripheral direction of the belt than the widthwise-movement restricting member is. The urging member applies tension to the belt in the peripheral direction

BRIEF DESCRIPTION OF THE DRAWINGS

Illustrative aspects in accordance with the invention will be described in detail with reference to the following figures wherein.

DETAILED DESCRIPTION

A belt device and an image forming apparatus according to some aspects of the invention will be described while referring to the accompanying drawings.

(a) Overall Structure of a Printer

Figure 1:
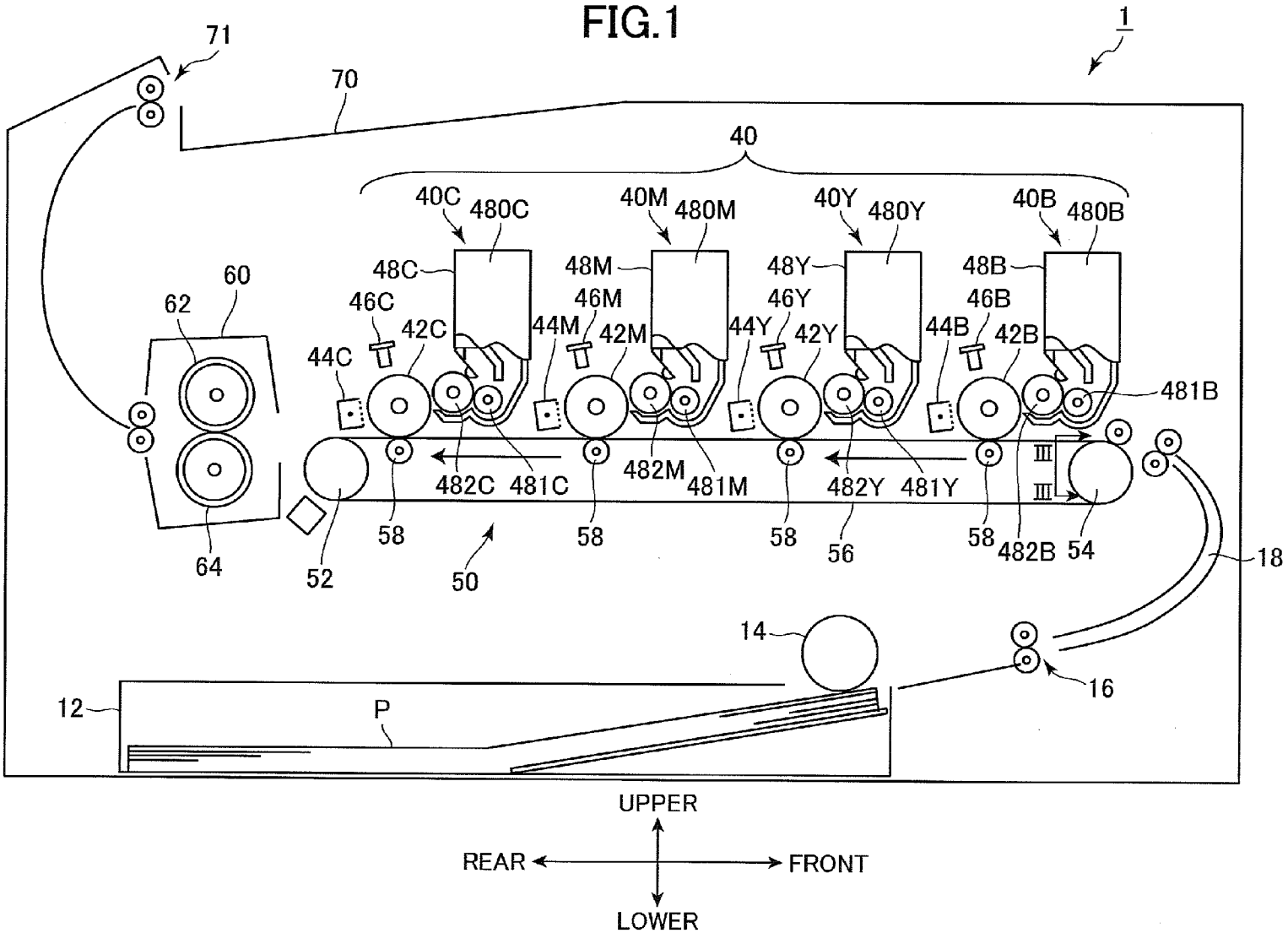
FIG. 1 is a vertical cross-sectional view of a printer taken through the center thereof, according to illustrative aspects of the invention.

FIG. 1 is a vertical cross-sectional view of a printer 1 according to illustrative aspects of the invention along the center thereof.

In the following description, an upper and lower direction in FIG. 1 will be referred to as a "vertical direction"; a left and right direction in FIG. 1 as a "front-rear direction"; a direction toward the viewer of FIG. 1 as a "right direction"; and a direction away from the viewer of FIG. 1 as a "left direction." Also, the expressions "front", "rear", "upper", "lower", "right", and "left" are used to define the various parts when the printer 1 is disposed in an orientation in which it is intended to be used.

The printer 1 of the illustrative aspects is a direct tandem type color laser printer. As shown in FIG. 1, the printer 1 includes a box-shaped paper tray 12 that is open on the top for loading a paper P therein and that is detachably mounted in a lower section of the printer 1; a feeding roller 14 disposed above one end of the paper tray 12 for feeding the paper P loaded in the paper tray 12 one sheet at a time; a pair of conveying rollers 16 disposed downstream of the feeding roller 14 in a paper-conveying direction (hereinafter simply referred to as "downstream") for conveying the sheets of paper P fed by the feeding roller 14; a guide 18 disposed downstream of the conveying rollers 16 for guiding the paper P conveyed by the conveying rollers 16; image forming units 40 disposed downstream of the guide 18 for forming images on the paper P conveyed along the guide 18; a conveying unit 50 disposed below the image forming units 40 for conveying the paper P conveyed along the guide 18 past transfer positions at which the image forming units 40 form images on the paper P; a fixing unit 60 disposed downstream of the image forming units 40 for fixing the images formed on the paper P by the image forming units 40 with heat and pressure; and a pair of discharge rollers 71 disposed downstream of the fixing unit 60 for discharging the paper P onto a discharge tray 70 after the fixing unit 60 has fixed an image on the paper P.

Four of the image forming units 40 are provided along the conveying unit 50 in the paper-conveying direction (indicated by arrows in FIG. 1) and include image forming units 40C, 40M, 40Y, and 40B that form images in cyan, magenta, yellow, and black, respectively In the following description, components of the image forming units 40 may have the letters C, M, Y, or B appended to their reference numeral to indicate the corresponding image forming unit 40C, 40M, 40Y, or 40B. However, components having the same reference numeral in front of the appended letter have the same construction but merely function to form images in a different color of developer.

Since the image forming units 40 all have the same structure, only the cyan image forming unit 40C will be described below, but this description shall be representative of the magenta, yellow, and black image forming units 40M, 40Y, and 40B, as well.

The cyan image forming unit 40C includes a photosensitive drum 42C that bears an electrostatic latent image on the surface thereof; a charger 44C that charges the surface of the photosensitive drum 42C; a scanner 46C that forms electrostatic latent images on the photosensitive drum 42C; and a developing unit 48C that forms developer images of the latent images by depositing developer on the photosensitive drum 42C.

The charger 44C is a Scorotron charger having a charging wire formed of tungsten or the like for producing a corona discharge and functions to charge the surface of the photosensitive drum 42C with a uniform positive polarity.

The scanner 46C includes a laser light-emitting unit for generating a laser beam, lens, and the like for forming electrostatic latent images on the surface of the photosensitive drum 42C.

The developing unit 48C includes an accommodating chamber 480C that accommodates developer, a supply roller 481C that conveys the developer from the accommodating chamber 480C, and a developing roller 482C that forms developer images on the photosensitive drum 42C by supplying developer conveyed by the supply roller 481C to the surface of the photosensitive drum 42C while simultaneously charging the developer with a positive polarity.

The conveying unit 50 includes a drive roller 52 disposed on the downstream side in the paper-conveying direction that is capable of receiving a driving force from a motor (not shown) provided in the printer 1; a follow roller 54 disposed on the upstream side of the conveying unit 50 in the paper-conveying direction; an endless belt 56 looped around the drive roller 52 and follow roller 54; four transfer rollers 58 disposed at positions confronting the photosensitive drums 42C, 42M, 42Y, and 42B with the belt 56 interposed therebetween; and a belt frame 80 (see FIG. 4) that supports the drive roller 52, follow roller 54, and transfer rollers 58.

The fixing unit 60 includes a heating roller 62 configured of a metal tube housing a halogen lamp that extends in the axial direction of the tube; and a pressure roller 64 for pressing a sheet of paper P conveyed from the conveying unit 50 against the heating roller 62 and conveying the sheet toward the discharge rollers 71.

Next, the operations of the printer 1 will be described.

First, the charger 44C charges the surface of the photosensitive drum 42C with a uniform positive polarity. Subsequently, the scanner 46C irradiates a laser beam onto the surface of the photosensitive drum 42C, which beam is modulated according to image data for an image to be formed on the paper P. The electric potential in regions of the photosensitive drum 42C exposed to the laser beam is reduced to form a latent image.

The developing unit 48C supplies positively charged developer to the surface of the photosensitive drum 42C. The developer adheres only to the regions on the surface of the photosensitive drum 42C that have been exposed to the laser beam, developing the latent image into a developer image.

As the photosensitive drum 42C rotates, the developer image borne on the surface of the photosensitive drum 42C rotates to the transfer position in confrontation with the transfer roller 58.

The same operations are carried out with the image forming units 40M, 40Y, and 40B.

While the above operations are performed, the feeding roller 14 and conveying rollers 16 are simultaneously rotated to convey a sheet of paper P to the conveying unit 50 and image forming units 40.

As the drive roller 52 of the conveying unit 50 is rotated at a predetermined timing, the belt 56 conveys the paper P toward the transfer positions.

As the belt 56 conveys the paper P through the transfer positions, a transfer bias voltage is applied between each of the four photosensitive drums 42 and the corresponding transfer rollers 58. This bias voltage causes the developer images formed on the surfaces of the image forming units 40 to transfer onto the surface of the paper P in sequence, forming a color image on the paper P.

In the fixing unit 60, the pressure roller 64 rotates to convey the paper P downstream, while the heating roller 62 and pressure roller 64 cooperate to apply heat and pressure to the paper P for fixing the developer image to the surface of the paper P.

After the developer image is fixed to the paper P, the discharge rollers 71 downstream of the fixing unit 60 discharge the paper P onto the discharge tray 70.

(b) Conveying Unit

Next, the conveying unit 50 will be described in detail with reference to FIGS. 1 through 4.

Figure 2:
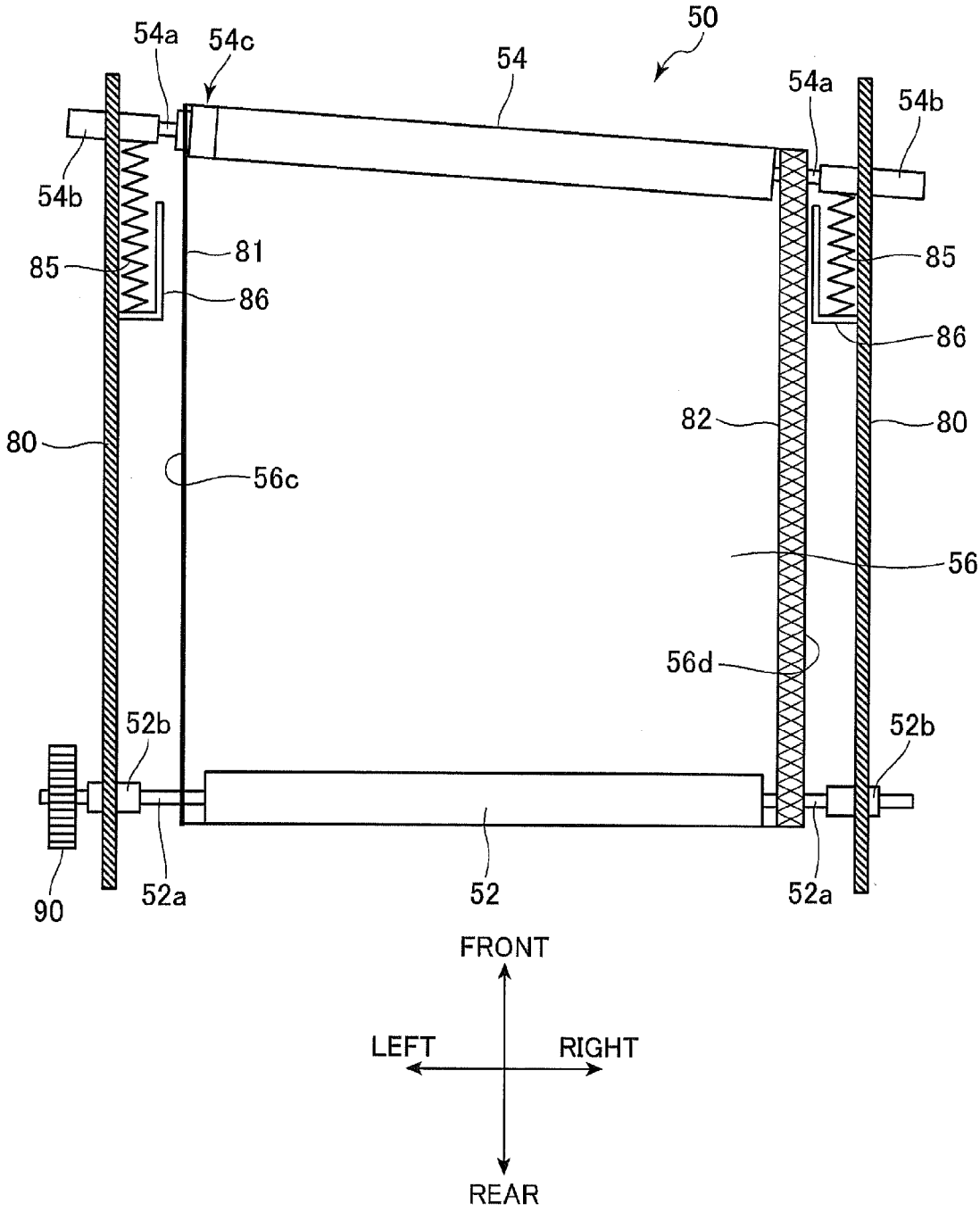
FIG. 2 is a plan view of a conveying unit provided in the printer shown in FIG. 1.

FIG. 2 is a plan view of the conveying unit 50 shown in FIG. 1. In FIG. 2, the belt 56 is depicted transparently to reveal parts hidden thereby, and the transfer rollers 58 have been omitted.

Figure 3:
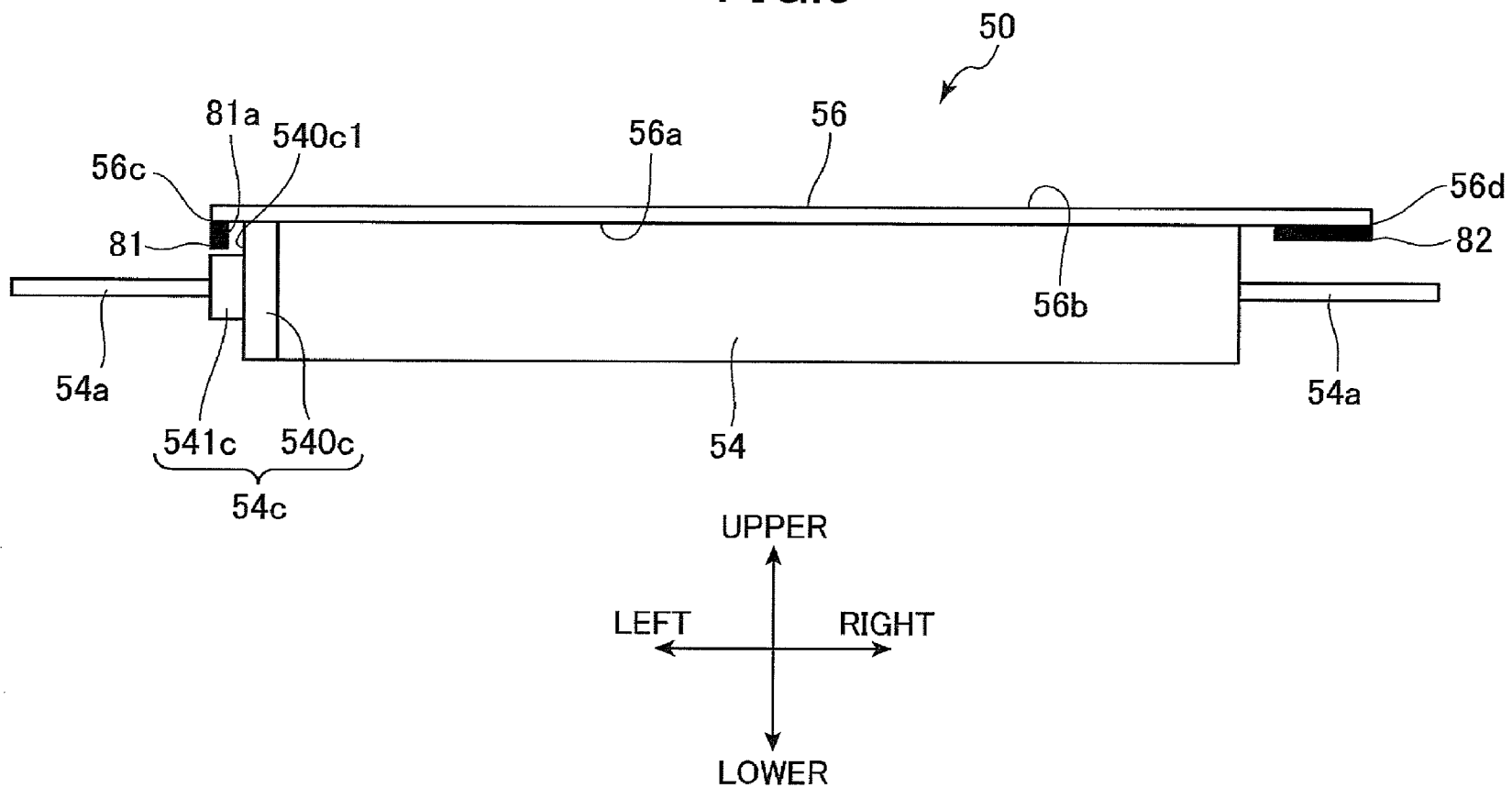
FIG. 3 is a cross-sectional view showing part of the conveying unit along a line III-III in FIG. 1.

FIG. 3 is a cross-sectional view along a line III-III in FIG. 1 showing a portion of the conveying unit 50.

As shown in FIGS. 2 and 3, the conveying unit 50 includes the drive roller 52, the follow roller 54, the belt 56, a widthwise-movement restricting member 81, an expansion-contraction restricting member 82, and springs 85. The belt 56 is looped around the drive roller 52 and follow roller 54. The belt 56 has an inner peripheral surface 56*a* facing inside the loop of the belt 56 and outer peripheral surface 56*b* opposite the inner peripheral surface 56*a*. The belt 56 has a left edge 56*c* and a right edge 56*d* opposite the left edge 56*c* in the widthwise direction. The widthwise-movement restricting member 81 protrudes from the inner peripheral surface 56*a* on the left edge 56*c* of the belt 56 for contacting a contact part 54*c* (described later) of the follow roller 54, thereby restricting rightward movement of the belt 56. The expansion-contraction restricting member 82 is fixed to the right edge 56*d* of the belt 56 for restricting expansion and contraction of the belt 56 on the right edge 56*d* thereof. The springs 85 (FIG. 2) are disposed on both axial ends of the follow roller 54 for urging the follow roller 54 in a forward direction to apply tension to the belt 56 along the circumference (periphery) thereof. The springs 85 have substantially the same spring constants for applying substantially the same urging forces to bearings 54*b* (described later) in the forward direction.

The belt 56 is an endless belt with a circumferential length of 630 mm and a width of 230 mm, for example. The belt 56 is formed of a polymer material or synthetic resin with a Young's modulus of approximately 1100-1500 MPa.

As shown in FIGS. 2 and 3, the both widthwise ends of the belt 56 are free ends not supported by the follow roller 54 and drive roller 52. However, the paper P is supported within a width region on the outer peripheral surface 56*b* of the belt 56 in which the inner peripheral surface 56*a* is supported by the drive roller 52 and follow roller 54.

As shown in FIGS. 2 and 3, the widthwise-movement restricting member 81 and expansion-contraction restricting member 82 are provided on the inner peripheral surface 56*a* on left and right free ends of the belt 56 in the widthwise direction, respectively. The widthwise-movement restricting member 81 restricts a tendency of the belt 56 to move to the right, while the expansion-contraction restricting member 82 restricts the belt 56 from expanding and contracting in length (in the circumferential direction).

The widthwise-movement restricting member 81 has a long narrow shape with a width of 1.5 mm (in the left-right direction), a length of 630 mm (in the circumferential direction), and a thickness of 4 mm (in the upper-lower direction in FIG. 3) The widthwise-movement restricting member 81 is formed primarily of urethane or silicon having a Young's modulus of approximately 400 MPa.

The widthwise-movement restricting member 81 is fixed to the inner peripheral surface 56*a* of the belt 56 along the entire circumference thereof by double-sided tape. The widthwise-movement restricting member 81 is fixed to the left edge 56*c* of the belt 56 with a surface of 1.5 mm width and 630 mm length on the inner peripheral surface 56*a* of the belt 56. The widthwise-movement restricting member 81 protrudes from the inner peripheral surface 56*a* of the belt 56, by its thickness of 4 mm, toward a rotational shaft 54*a* of the follow roller 54 described later (i.e., toward inside the loop of the belt 56). The widthwise-movement restricting member 81 has a restricting surface 81*a* that faces rightward and is capable of contacting the contact part 54*c* of the follow roller 54 described later for restricting rightward movement of the belt 56.

The expansion-contraction restricting member 82 has a tape-like shape with a width of 15 mm (in the left-right direction), a length of 630 mm (in the circumferential direction), and a thickness of 100 micrometers (in the upper-lower direction in FIG. 3). The expansion-contraction restricting member 82 is formed primarily of polyester having a Young's modulus of approximately 4000 MPa.

The expansion-contraction restricting member 82 is fixed to the inner peripheral surface 56*a* of the belt 56 along the entire circumference thereof with double-sided tape. The expansion-contraction restricting member 82 is positioned on the right edge 56*d* of the belt 56, the opposite widthwise edge from the widthwise-movement restricting member 81, with its surface of 15 mm width and 630 mm length on the inner peripheral surface 56*a*.

As described above, the expansion-contraction restricting member 82 has a greater Young's modulus (approximately 4000 MPa) than the widthwise-movement restricting member 81 (approximately 400 MPa) and sufficiently larger surface area contacting the belt 56 (15 mm×630 mm) than a surface area of the widthwise-movement restricting member 81 (1.5 mm×630 mm). Therefore, the right edge 56*d* of the belt 56 is less likely to stretch than the left edge 56*c* of the belt 56.

As shown in FIG. 2, the drive roller 52 includes a rotational shaft 52*a*, and a pair of bearings 52*b* rotatably holding both ends of the rotational shaft 52*a*.

A gear 90 is fitted over one end of the rotational shaft 52*a* for transmitting a driving force from a motor (not shown) provided in the printer 1 to the rotational shaft 52*a*.

The peripheral surface of the drive roller 52 has been coated with a urethane or rubber in order to generate sufficient frictional force between the peripheral surface of the drive roller 52 and the belt 56 for conveying the belt 56.

As shown in FIG. 2, the follow roller 54 includes the rotational shaft 54*a* that supports the follow roller 54, and a pair of bearings 54*b* that rotatably hold both ends of the rotational shaft 54*a*.

As shown in FIG. 3, the contact part 54*c* is rotatably supported on the rotational shaft 54*a* between the follow roller 54 and the widthwise-movement restricting member 81 on the left side of the follow roller 54. The contact part 54*c* is capable of rotating relative to the rotational shaft 54*a*. The contact part 54*c* has a large diameter part 540*c* which has the same diameter as the follow roller 54, and a small diameter part 541*c* which has a smaller diameter than the large diameter part 540*c*. The contact part 54*c* prevents a tendency of the belt 56 to move rightward through contact between a contact surface 540*c*1 of the large diameter part 540*c* facing the widthwise-movement restricting member 81 and the restricting surface 81*a* of the widthwise-movement restricting member 81.

The peripheral surface of the follow roller 54 is coated with aluminum or the like to allow the belt 56 a degree of slippage on the peripheral surface of the follow roller 54.

Figure 4:
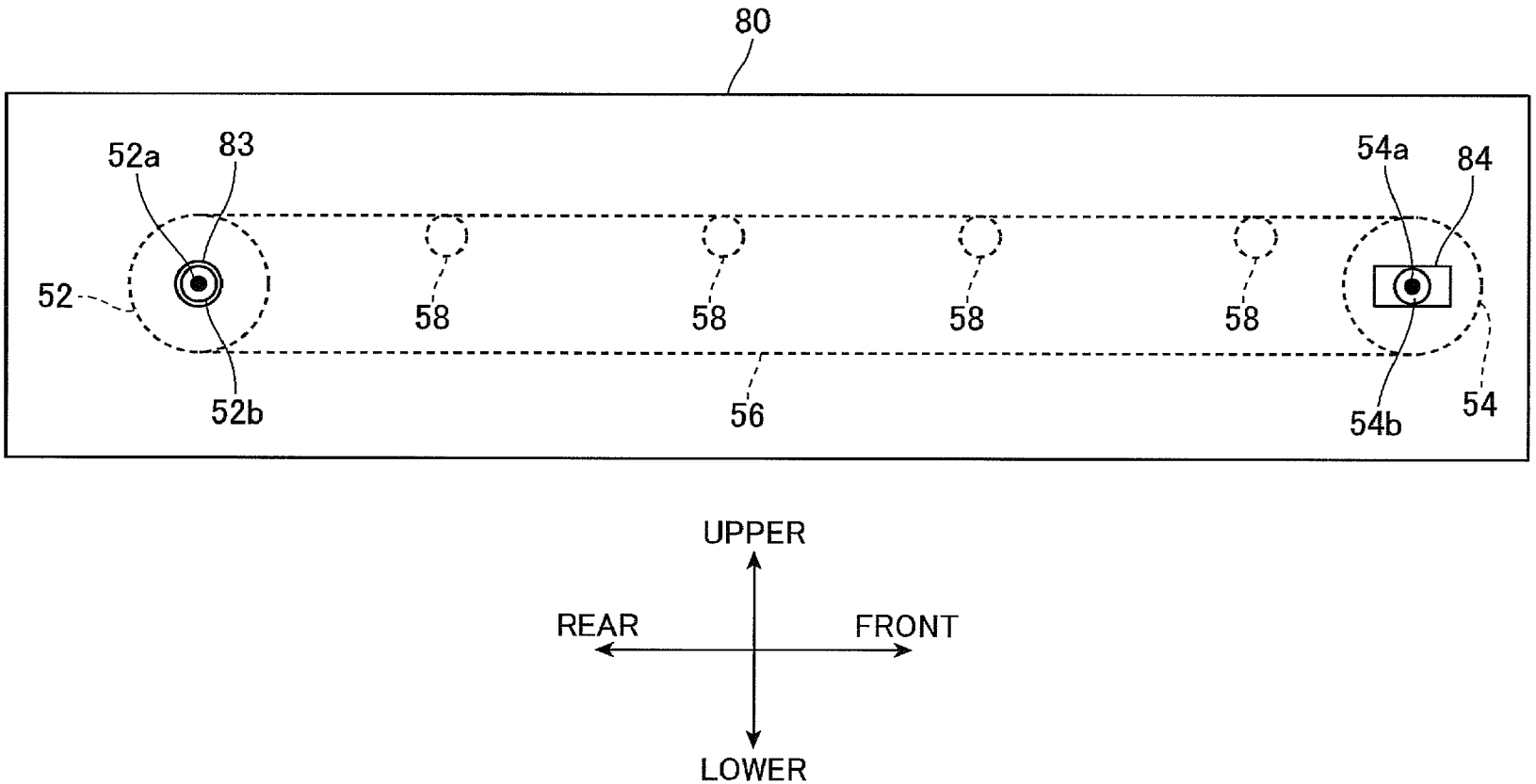
FIG. 4 is a right side view of the conveying unit.

FIG. 4 is a right side view of the belt frame 80, with members hidden by the belt frame 80 indicated with dotted lines.

As shown in FIG. 4, a pair of circular fixing holes 83 is formed in both sides (only the right side is shown in FIG. 4) of the belt frame 80, and the bearings 52*b* are fixed in the fixing holes 83 for rotatably holding the rotational shaft 52*a* of the drive roller 52. A pair of rectangular holes 84 extending in the front-rear direction (i.e., in the direction in which the drive roller 52 and the follow roller 54 are arranged) is also formed in the belt frame 80. The bearings 54*b* are retained in the rectangular holes 84 so as to be able to slide in the front-rear direction therein. The bearings 54*b* rotatably hold the rotational shaft 54*a* of the follow roller 54. As shown in FIG. 2, a pair of spring seats 86 is provided on the belt frame 80 for supporting the springs 85. The springs 85 urge the bearings 54*b* in a forward direction. The springs 85 have equivalent urging forces of approximately 3 kilograms force. By urging the bearings 54*b* of the follow roller 54 forward, the springs 85 apply tension to the belt 56 along the circumference thereof. While FIG. 4 shows only the right side of the belt frame 80, the structure for supporting the bearing 52*b* and bearing 54*b* is identical on the left side.

(c) Mounted State of the Belt

As shown in FIG. 2, the belt 56 is provided around the drive roller 52 and follow roller 54. In this state, the springs 85 urge the follow roller 54 via the bearings 54*b* and rotational shaft 54*a* in a forward direction, that is, a direction away from the drive roller 52. When tension is applied along the circumference of the belt 56 via the follow roller 54, the circumferential length of the belt 56 on the left edge 56*c* becomes approximately 0.1 mm longer than the circumferential length of the belt 56 on the right edge 56*d*. This is because the left edge 56*c* to which the widthwise-movement restricting member 81 is fixed expands easier than the right edge 56*d* to which the expansion-contraction restricting member 82 is fixed. Accordingly, the follow roller 54 is slanted with the left end positioned farther forward than the right end, since the bearings 54*b* holding the rotational shaft 54*a* can move in the front-rear direction within the rectangular holes 84. By tilting the follow roller 54 in this way, the frictional force that the belt 56 receives from the follow roller 54 has a component for sending the belt 56 rightward. Since a rightward force is applied to the inner peripheral surface 56*a* of the belt 56 contacting the follow roller 54, and the widthwise-movement restricting member 81 restricts rightward movement of the belt 56, this construction prevents skewing and widthwise movement of the belt 56. Further, the belt 56 is pulled (stretched) in the widthwise direction, preventing the belt 56 from wrinkling.

(d) Effects of the Illustrative Aspects

Next, effects obtained in the structure of the illustrative aspects will be described.

Since the construction of the illustrative aspects eliminates the need to produce a tension differential between the left edge 56*c* and right edge 56*d* of the belt 56, the construction of the illustrative aspects can reduce the load applied to the belt 56 and the like.

Further, the expansion-contraction restricting member 82 and widthwise-movement restricting member 81 are provided on free ends of the belt 56 outside of the paper-conveying region and, hence, do not impede paper conveyance.

By providing the expansion-contraction restricting member 82 on the inner peripheral surface 56*a* of the belt 56, the construction of the illustrative aspects prevents the expansion-contraction restricting member 82 from interfering with components positioned in the vicinity of the outer peripheral surface 56*b* of the belt 56 or a paper P which has been incorrectly conveyed to outside the paper-conveying region.

By forming the expansion-contraction restricting member 82 in a tape shape, the expansion-contraction restricting member 82 can easily be fixed to the belt 56 with double-sided tape.

The widthwise-movement restricting member 81 and the expansion-contraction restricting member 82 are provided on edges of the belt 56. Thus, the edges of the belt 56 can be prevented from being damaged by bending greatly due to the drive roller 52 and follow roller 54 and by contacting other members. In other words, since the widthwise-movement restricting member 81 and the expansion-contraction restricting member 82 are fixed to the edges of the belt 56, the belt edges can be reinforced.

The Young's modulus of the expansion-contraction restricting member 82 is greater than the Young's modulus of the belt 56. Hence, the expansion and contraction of the belt 56 can be restricted more reliably than a configuration in which the Young's modulus of the expansion-contraction restricting member is set smaller than the Young's modulus of the belt 56.

Fixing the expansion-contraction restricting member 82 along the entire circumference of the belt 56 suppresses irregular expansion and contraction of the belt 56, thereby ensuring stable operations of the belt 56. That is, the belt speed can be made uniform. Accordingly, the printer 1 can form high quality images because the conveying unit 50 conveys paper P with stability.

While the invention has been described in detail with reference to the above aspects thereof, it would be apparent to those skilled in the art that various changes and modifications may be made therein without departing from the spirit of the invention.

For example, while the Young's modulus of the belt 56 is set to approximately 1100-1500 MPa in the illustrative aspects, this value may be set even lower. By setting a lower Young's modulus for the belt 56, it is possible to produce a difference in circumferential length in the belt 56 more reliably with a smaller tension.

Further, it is important that the expansion-contraction restricting member 82 be less apt to expand in the circumferential direction of the belt 56 than the widthwise-movement restricting member 81, though the Young's modulus of the expansion-contraction restricting member 82 need not be set greater than the Young's modulus of the widthwise-movement restricting member 81. In other words, the Young's modulus may be set equally for the expansion-contraction restricting member 82 and widthwise-movement restricting member 81, provided that either (1) the surface area of the expansion-contraction restricting member 82 fixed to the belt 56 is sufficiently greater than the surface area of the widthwise-movement restricting member 81 fixed to the belt 56 or (2) the thickness of the expansion-contraction restricting member 82 is sufficiently greater than the thickness of the widthwise-movement restricting member 81.

Further, in the illustrative aspects, the circumferential length of the belt 56 on the left edge 56*c* becomes greater, due to expansion, by approximately 0.1 mm than the right edge 56*d*. This difference in circumferential length may be set to approximately 1 mm.

The widthwise-movement restricting member 81 may also be tape-shaped, where "tape-shaped" is defined as a shape having a smaller thickness dimension (in the upper-lower direction in FIG. 3) than a width dimension (in the left-right direction) and a length dimension (along the circumference).

The expansion-contraction restricting member 82 may also be shaped as a long slender cord.

Further, the belt may be an intermediate transfer belt or a photosensitive belt. That is, the belt device is provided in an image forming unit of an image forming apparatus. In this case as well, the image forming apparatus can form high quality images because the belt conveys developer image or the like with stability.

In addition, the belt device may be applied to an image forming apparatus other than an electrophotographic type, such as an inkjet type image forming apparatus.

Further, the belt device may be applied to a device other than an image forming apparatus, such as a post-process device for performing post-processing on a recording medium that is detachably mounted on the image forming apparatus.

Further, while the widthwise-movement restricting member 81 and expansion-contraction restricting member 82 are provided on edges of the belt 56 in the illustrative aspects, these components need not be mounted exactly on the edges. For example, the expansion-contraction restricting member 82 may be provided simply on the right side of the belt 56 (i.e., adjacent to the right edge 56*d*), rather than exactly on the right edge.

In the illustrative aspects, the widthwise-movement restricting member 81 and the expansion-contraction restricting member 82 are fixed to the inner peripheral surface 56*a* of the belt 56 by double-sided tape. However, these components may be fixed to the belt 56 by adhesive or other fixing means.

In the illustrative aspects, the widthwise-movement restricting member 81 and the expansion-contraction restricting member 82 are provided along the entire circumference of the belt 56. However, these components need not necessarily be provided along the entire circumference, but may be provided partially along the circumference of the belt.

What is claimed is:

1. A belt device comprising:

a plurality of rollers including:

a drive roller configured to be supplied with a driving force; and a follow roller that follows rotation of the drive roller;

a belt looped around the plurality of rollers, the belt having an inner peripheral surface facing inside of a loop of the belt and an outer peripheral surface opposite the inner peripheral surface, the belt having a first widthwise edge and a second widthwise edge opposite the first widthwise edge in a widthwise direction;

an urging member that applies tension to the belt in a circumferential direction orthogonal to the widthwise direction;

a widthwise-movement restricting member disposed on the inner peripheral surface on a first widthwise edge side, the widthwise-movement restricting member restricting widthwise movement of the belt in a direction toward a second widthwise edge side; and an expansion-contraction restricting member disposed on the second widthwise edge side on at least one of the inner peripheral surface and the outer peripheral surface, the expansion-contraction restricting member restricting expansion-contraction of the belt so that a circumferential length in the second widthwise edge side is shorter than a circumferential length in the first widthwise edge side when the belt is applied with tension in the circumferential direction.

2. The belt device according to claim 1, wherein the expansion-contraction restricting member is disposed on the inner peripheral surface.

3. The belt device according to claim 1, wherein the expansion-contraction restricting member and the widthwise-movement restricting member are provided on the belt outside of a recording-medium conveying region in which the recording medium is conveyed.

4. The belt device according to claim 1, wherein the expansion-contraction restricting member comprises a tape-shaped member that is fixed to the inner peripheral surface along the second widthwise edge.

5. The belt device according to claim 1, wherein the widthwise-movement restricting member protrudes toward inside of the loop of the belt and has a restricting surface facing toward the second widthwise edge side; and wherein at least one of the plurality of rollers has a contact member configured to contact the restricting surface, thereby restricting movement of the belt in the direction toward the second widthwise edge side.

6. The belt device according to claim 5, wherein the widthwise-movement restricting member comprises a tape-shaped member that is fixed to the inner peripheral surface along the first widthwise edge.

7. The belt device according to claim 1, wherein the expansion-contraction restricting member has a Young's modulus greater than a Young's modulus of the belt.

8. The belt device according to claim 1, wherein the expansion-contraction restricting member has a Young's modulus greater than a Young's modulus of the widthwise-movement restricting member.

9. The belt device according to claim 1, wherein the expansion-contraction restricting member contacts the belt in a contact area larger than a contact area in which the widthwise-movement restricting member contacts the belt.

10. The belt device according to claim 1, wherein the expansion-contraction restricting member is provided along an entire periphery of the belt.

11. The belt device according to claim 1, further comprising a pair of bearings that rotatably supports the follow roller at both ends in the widthwise direction, wherein the urging member comprises a pair of springs that urges the pair of bearings in a direction away from the drive roller; and wherein the pair of springs has substantially a same spring constant.

12. The belt device according to claim 1, further comprising:

a pair of bearings that rotatably supports the follow roller at both ends in the widthwise direction; and a belt frame formed with a pair of through-holes each extending in an arrangement direction in which the drive roller and the follow roller are arranged, allowing the pair of bearings to be able to slide in the arrangement direction within the pair of through-holes.

13. An image forming apparatus comprising:

a conveying unit that conveys a recording medium; and an image forming unit that forms an image on the recording medium conveyed by the conveying unit, wherein at least one of the conveying unit and the image forming unit comprises a belt device including:

a plurality of rollers including:

a drive roller configured to be supplied with a driving force; and a follow roller that follows rotation of the drive roller;

a belt looped around the plurality of rollers, the belt having an inner peripheral surface facing inside of a loop of the belt and an outer peripheral surface opposite the inner peripheral surface, the belt having a first widthwise edge and a second widthwise edge opposite the first widthwise edge in a widthwise direction;

an urging member that applies tension to the belt in a circumferential direction orthogonal to the widthwise direction;

a widthwise-movement restricting member disposed on the inner peripheral surface on a first widthwise edge side, the widthwise-movement restricting member restricting widthwise movement of the belt in a direction toward a second widthwise edge side; and an expansion-contraction restricting member disposed on the second widthwise edge side on at least one of the inner peripheral surface and the outer peripheral surface, the expansion-contraction restricting member restricting expansion-contraction of the belt so that a circumferential length in the second widthwise edge side is shorter that a circumferential length in the first widthwise edge side when the belt is applied with tension in the circumferential direction.

14. The image forming apparatus according to claim 13, wherein the expansion-contraction restricting member is disposed on the inner peripheral surface.

15. The image forming apparatus according to claim 13, wherein the expansion-contraction restricting member comprises a tape-shaped member that is fixed to the inner peripheral surface along the second widthwise edge.

16. The image forming apparatus according to claim 13, wherein the widthwise-movement restricting member protrudes toward inside of the loop of the belt and has a restricting surface facing toward the second widthwise edge side; and wherein at least one of the plurality of rollers has a contact member configured to contact the restricting surface, thereby restricting movement of the belt in the direction toward the second widthwise edge side.

17. The image forming apparatus according to claim 16, wherein the widthwise-movement restricting member comprises a tape-shaped member that is fixed to the inner peripheral surface along the first widthwise edge.

18. The image forming apparatus according to claim 13, wherein the expansion-contraction restricting member has a Young's modulus greater than a Young's modulus of the belt.

19. The image forming apparatus according to claim 13, wherein the expansion-contraction restricting member has a Young's modulus greater than a Young's modulus of the widthwise-movement restricting member.

20. The image forming apparatus according to claim 13, wherein the expansion-contraction restricting member is provided along an entire periphery of the belt.

* * * * *